United States Patent [19]

Culbertson

[11] Patent Number: 4,913,308

[45] Date of Patent: Apr. 3, 1990

[54] LINER RETAINER APPARATUS AND METHOD

[76] Inventor: Russell D. Culbertson, 3543 Greystone Dr., #1099, Austin, Tex. 78731

[21] Appl. No.: 345,093

[22] Filed: Apr. 28, 1989

[51] Int. Cl.[4] ..... B65D 25/16

[52] U.S. Cl. ..... 220/404; 220/1 T

[58] Field of Search ..... 220/1 T, 404, 407, 401, 220/263, 94 A

[56] References Cited

U.S. PATENT DOCUMENTS

| | | | |
|---|---|---|---|
| 3,008,604 | 11/1961 | Garner | 220/263 X |
| 3,052,371 | 9/1962 | Van Bemmelen | 220/404 X |
| 3,450,297 | 6/1969 | Clerk | 220/263 |
| 3,893,615 | 7/1975 | Johnson | 220/1 T X |
| 3,964,630 | 6/1976 | Getz | 220/1 T X |
| 4,364,477 | 12/1982 | Stromberg | 220/94 A X |
| 4,765,579 | 8/1988 | Robbins, III et al. | 220/404 X |

*Primary Examiner*—Steven M. Pollard

[57] ABSTRACT

A liner retainer is provided for retaining the mouth of a flexible liner bag open and in position for receiving objects in the bag. The liner retainer includes a retainer member and a retainer channel connected to and extending around the perimeter of a deposit opening, the top opening of a trash receptacle, for example. A liner bag may be positioned with its mouth portion material tucked or otherwise inserted into the retainer channel and the retainer member is adapted to be inserted into the channel over the liner material to retain the material in the channel.

32 Claims, 5 Drawing Sheets

LINER RETAINER APPARATUS AND METHOD

BACKGROUND OF THE INVENTION

The invention relates to linear retainers, and more particularly, to a waste receptacle liner retainer apparatus for retaining the mouth of a flexible liner bag open and in position for receiving objects in the liner bag. The invention also encompasses methods for retaining a liner bag in position for receiving objects.

Waste or trash receptacles are commonly lined with a suitable disposable liner bag. The liner bags include a mouth or opening and are adapted to be received in the trash receptacle with the liner bag mouth generally aligning with the opening of the trash receptacle. The liner bag mouths were heretofore commonly retained in the open position by being stretched or folded over the trash receptacle opening.

There were a number of problems associated with retaining a liner bag in position for receiving trash by stretching or folding the liner mouth portion over a trash receptacle opening. First, the liner bag material was weakened by such stretching and the weakened material was susceptible to breakage or tearing when the liner was being removed from the receptacle. Also, since the retention of the liner depended upon a tight fit between the liner bag and the trash receptacle opening, the liner bag had to be carefully sized for the receptacle in which it was used. If the liner bag mouth portion was too big for the trash receptacle opening, the mouth portion material had to be tied in a knot to take up the extra material to help secure the mouth portion in the open position aligned with the trash receptacle opening. Even if the fit between the mouth portion and the trash receptacle opening was fairly good, the liner mouth portion could easily slip back over the trash receptacle opening and collapse into the receptacle, preventing further trash from being deposited into the liner bag. Furthermore, whether the mouth portion material was stretched, folded, or tied over the trash receptacle opening, the liner material was exposed to view around the trash receptacle opening, adversely affecting the receptacle's overall appearance.

Another problem associated with folding or stretching the liner mouth portion over the trash receptacle opening arose where the receptacle included a lid and lid raising mechanism or a locking mechanism for locking the lid in a closed position. The liner material extending over the trash receptacle opening tended to interfere with the operation of these types of lids and lid raising or locking mechanisms, particularly by getting caught in and jamming the mechanism. In order to prevent any such interference, the liner bag mouth portion had to be pulled into the receptacle adjacent the particular mechanism. However, this releasing of the liner bag mouth portion at points along the perimeter of the trash receptacle opening allowed the remainder of the mouth portion to collapse into the receptacle preventing further trash from being deposited.

SUMMARY OF THE INVENTION

It is a general object of the invention provide a liner bag retainer apparatus adapted to overcome the above described problems associated with retaining flexible liner bags in a trash or other receptacle in position for receiving objects.

More particularly, it is an object of the invention to provide a liner bag retainer for retaining the mouth portion of the bag in the open position without substantially exposing the liner material around the outside of the trash receptacle opening.

Another object of the invention is to provide a liner retainer apparatus adapted for retaining a liner bag mouth portion in an open position without interfering with the operation of lid raising or locking mechanism associated with the trash receptacle.

Yet another object of the invention is to provide a liner bag retainer apparatus by which a liner bag mouth portion may easily and quickly be retained in an open position even where the liner bag mouth or opening is substantially larger that the trash receptacle opening.

A further object of the invention is to provide a method for retaining the mouth of a flexible liner bag in an open position that overcomes the above described problems associated with retaining such liners.

A liner retainer pursuant to the invention includes a retainer channel and a retainer member. The retainer channel is positioned so as to extend around the entire perimeter of the deposit opening or top opening of a suitable receptacle. A flexible liner bag may be positioned in the receptacle with the liner mouth up and generally aligned with the receptacle opening, and the material around the liner mouth, or the liner mouth portion, may be tucked into the retainer channel. The retainer member is adapted to be inserted into the channel over the liner mouth material to retain the material firmly in the channel. Thus, the channel and retainer member combination retains the liner mouth open and in position for receiving objects, and at the same time, hides the liner mouth material from view.

One preferred form of the invention includes a retainer ridge, or series of ridges, spaced out along the length of the retainer channel, adapted to engage the retainer member so as to help retain the retainer member in the retainer channel once properly inserted therein. In one preferred form of the invention the ridges are positioned near the top of the channel and extend slightly into the channel so that the retainer member must flex slightly to pass over the ridges as it is inserted or removed from the retainer channel. In this form of the invention the retainer member is made of a somewhat flexible material such as a suitable plastic.

To help facilitate removal of the retainer member from the retainer channel, such as when changing or emptying liner bags, the retainer member preferably includes grip means. The preferred grip means are adapted to provide a lip or grip member which may be grasped for pulling the retainer member from the retainer channel.

A retainer channel according to the invention may also include an excess channel portion into which the retainer member does not extend when it is properly received therein. The excess channel portion provides room for containing excess liner mouth material. Preferably a number of rib members are included in the excess channel portion of the channel, spaced apart along the entire length of the channel, for providing strength to the channel structure. Each rib member may be a solid plate of material extending transversely across the channel from one channel wall to another so as to help retain the channel walls in the desired orientation with each other. Also, the rib members and retainer channel are preferably integrally formed from a suitable substantially rigid plastic material by a suitable molding process.

A liner retainer according to the invention may be connected to, or be adapted to connect to the top opening or deposit opening of a trash receptacle compartment. The retainer channel is preferably V-shaped, having an inner wall, an outer wall, and a top opening. The trash receptacle and retainer channel are preferably integrally formed from a suitable plastic material, the retainer channel being connected to the trash receptacle at the base of the V-shape.

A trash receptacle and liner retainer combination according to the invention, may also include a lid and lid raising mechanism. The lid is preferably pivotally connected on one side of the receptacle outside of the perimeter of the deposit opening and retainer channel, near the outer channel wall. The lid is adapted to pivot between an open position in which the receptacle deposit opening is exposed for receiving trash, and a closed position covering deposit opening of the trash receptacle compartment. The lid raising mechanism includes a lifting member slidably mounted outside of the receptacle compartment and extending from near the bottom of the receptacle to near the top opening. A foot pedal is mounted near the bottom of the receptacle and is adapted to raise or slide the lifting member upward so as to contact the lid or a lid extension to pivot the lid from its closed position to its open position. Since both the lid and the lid raising mechanism operate outside of the perimeter of the receptacle and the retainer channel, the lid and raising mechanism do not interfere with the retention of the liner. Furthermore, the liner may be securely retained in the retainer channel without interfering with the operation of the lid or lid lifting mechanism.

The liner retainer pursuant to the invention may also be advantageously incorporated into a trash receptacle having multiple trash compartments for segregating different types of trash, for recycling purposes for example. A multi-compartment trash receptacle may have two side-by-side compartments separated by a common wall. A liner retainer channel may be connected as previously described around each deposit opening for retaining a liner in each compartment. Since the liner mouth portion is retained in the retainer channel for each separate compartment, the common wall does not prevent the liners from being securely retained.

These and other objects, advantages, and features of the invention will be apparent from the following description of preferred embodiments considered along with the accompanying drawings.

DESCRIPTION OF THE PREFERRED EMBODIMENTS

Figure 1:
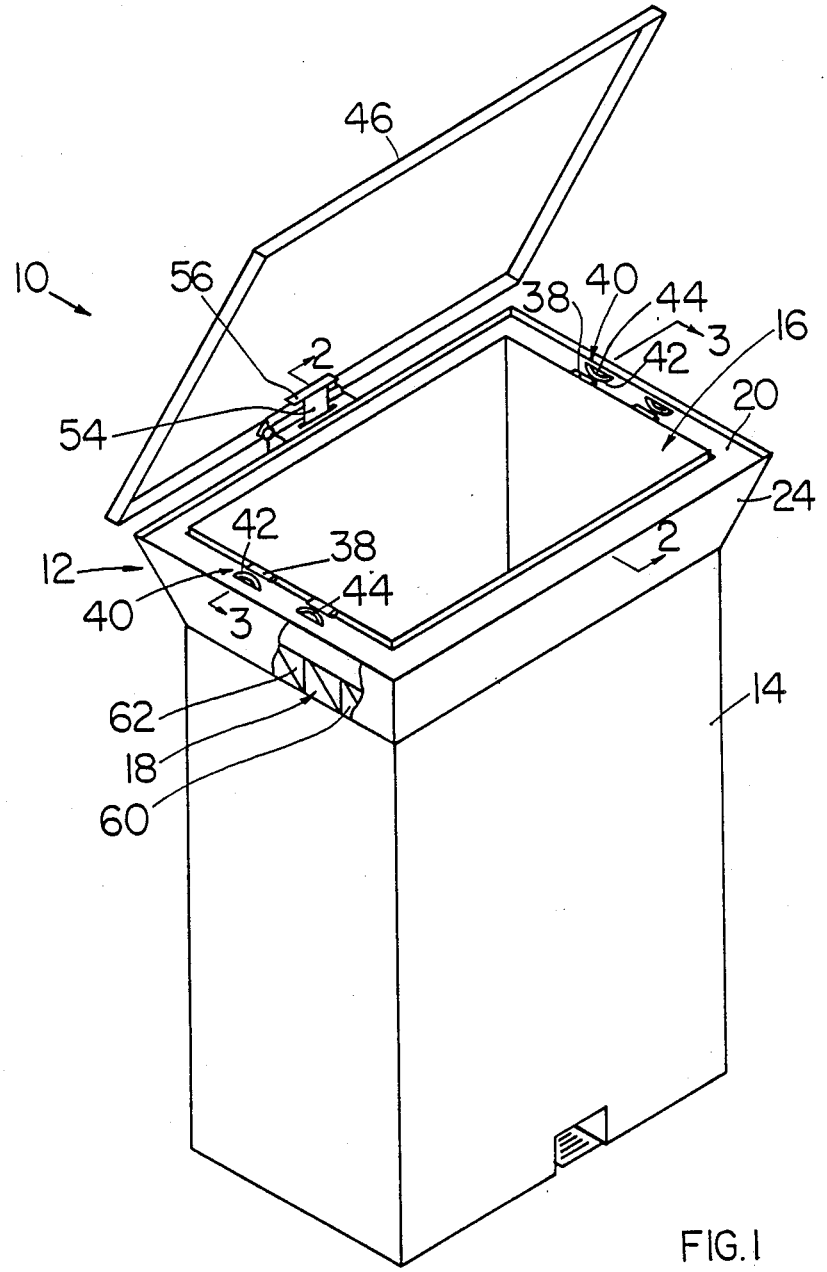
FIG. 1 is a view in perspective showing a trash receptacle with a liner retainer embodying the principles of the invention, with a portion of the retainer channel shown cut away.
Figure 2:
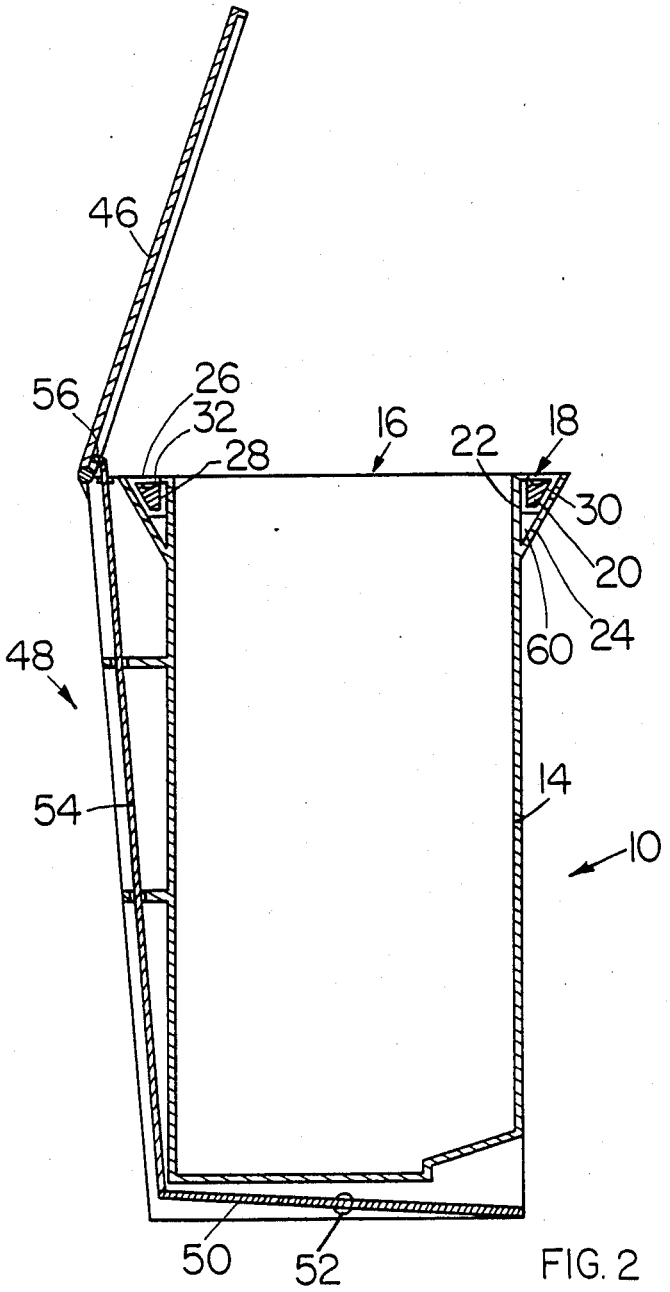
FIG. 2 is a view in section of the receptacle and liner retainer taken along line 2—2 in FIG. 1.

FIGS. 1 and 2 show a trash receptacle 10 having a liner retainer 12 embodying the principles of the invention. The trash receptacle 10 includes a receptacle compartment 14 with a deposit opening or top opening 16 at its top. The liner retainer 12 includes a retainer channel 18 and a retainer member 20, shown inserted into the retainer channel in a retaining position.

The retainer channel 18 is connected to and extends along the entire perimeter of the trash receptacle deposit opening 16. As shown best in FIG. 2, the retainer channel 18 includes an inner channel wall 22, an outer channel wall 24, and a top channel opening 26, the retainer member being adapted to be inserted into the channel through the top channel opening. Also, the inner channel wall 22 may preferably be the continuation of the trash receptacle compartment wall, the outer channel wall 24 of the channel 18 diverging away from the receptacle/inner channel wall.

The retainer member 20 in the illustrated form of the invention comprises a single continuous ring member. Again referring particularly to FIG. 2, the retainer ring member or ring member 20 has a wedge-shaped transverse cross-section to correspond substantially to the V-shape of the retainer channel 18. The ring member 20 includes an inner surface 28 adapted to substantially abut at least a portion of the inner channel wall 22, an outer surface 30 adapted to substantially abut at least a portion of the outer channel wall 24, and a top surface 32 adapted to be near the level of the top channel opening 26 when the ring member is properly received or inserted in the channel.

A contact means includes at least one retainer ridge member 38 is provided on the inner channel wall 22 on opposite sides of the deposit opening 16. Each ridge member 38 extends slightly into the retainer channel 18 and is adapted to contact the retainer ring member 20 when it is properly received in the retainer channel to help hold the retainer ring in the channel.

The retainer ring member 20 also preferably includes removal grip means 40 adapted for helping facilitate removal of the retainer ring member from the retainer channel. In the form of the invention illustrated in FIG. 1, the removal grip means 40 include a pluralilty of grip indentations 42 in the top surface 32 of the retainer ring member 20, each indentation with a small lip portion 44 along one edge thereof. The lip portion 44 of each removal grip means 40 may be gripped with the tip of the finger or fingernail for pulling the retainer ring member from the channel.

As shown in both FIGS. 1 and 2, but perhaps best in FIG. 2, the trash receptacle 10 also includes a lid 46 and lid raising mechanism 48. The lid 46 is pivotally connected to the receptacle 10 near the top of one side thereof, outside of the perimeter of the retainer channel outer wall 24. The lid 46 is adapted for pivoting between a lowered position covering the receptacle deposit opening 16 and a raised position exposing the receptacle opening as shown in FIG. 2. The lid raising mechanism 48 includes a foot pedal member 50 pivotally connected at a suitable pedal connection 52 to the receptacle near the bottom thereof, and a lifting member 54 slidably mounted or connected to the receptacle outside of the receptacle compartment. The lifting member 54 extends substantially vertically from near the bottom of the receptacle 10 to near its top and is adapted to be raised or lifted upwardly by the foot pedal member 50 as the pedal member pivots about connection 52 so as to contact and raise the lid 46 as in FIG. 2. In the illustrated form of the invention, the lid 46 also includes an extension member 56 which the lifting member 54 contacts directly as it slides upwardly, thereby raising the lid.

As shown in FIG. 1, the preferred form of the liner retainer 12 includes an excess channel portion 60 in the bottom of the retainer channel 18, opposite the top channel opening 26. The retainer ring member 20 is adapted so as not the extend into this excess channel portion 60 when the ring member is properly received in the channel 18. The excess channel portion 60 provides space for receiving excess liner mouth portion material as will be described with reference to FIGS. 3 and 4. Also, a plurality of rib members 62 are preferably positioned in the excess channel portion 60, the rib members being spaced out along the entire length of the retainer channel 18. The preferred rib members 62 are solid plates of material connected to and extending transversely across the channel between the inner channel wall 22 and outer channel wall 24 for providing added strength to the retainer channel structure. Where the retainer channel 18 is formed from a suitable plastic material, the ribs are preferably integrally formed with the retainer channel walls in a suitable molding process.

Figure 3:
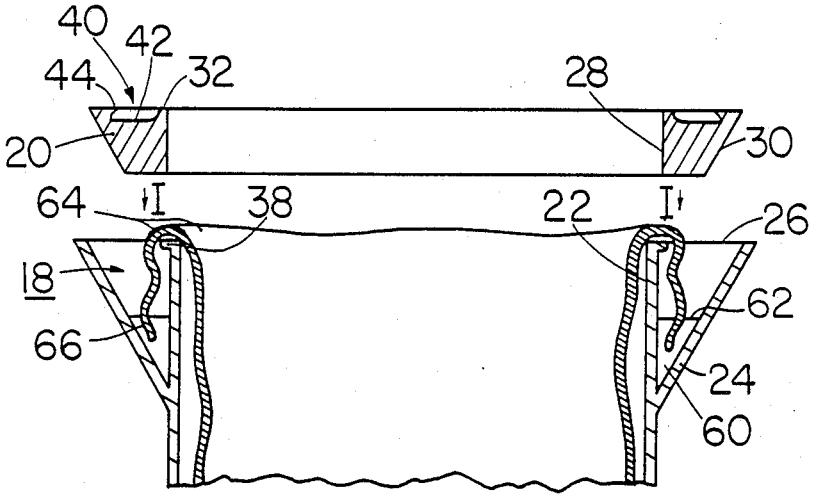
FIG. 3 is a view in section of the liner retainer taken along line 3—3 in FIG. 1, but showing the retainer ring removed and a liner bag loosely received in the retainer channel.

FIG. 3 shows the liner retainer 12 of the trash receptacle 10 shown in FIG. 1 with a flexible liner bag 64 received in the receptacle compartment 14. The liner bag 64 includes a mouth portion 66 which is shown having been tucked or otherwise inserted loosely into the retainer channel 18 between the inner channel wall 22 and the outer channel wall 24. Note also that the liner mouth portion material 66 must extend over the ridge members 38 to be properly or fully received in the retainer channel 18. The retainer ring member 20 is shown being held above the retainer channel in position to be inserted into the channel as indicated by arrows I.

Figure 4:
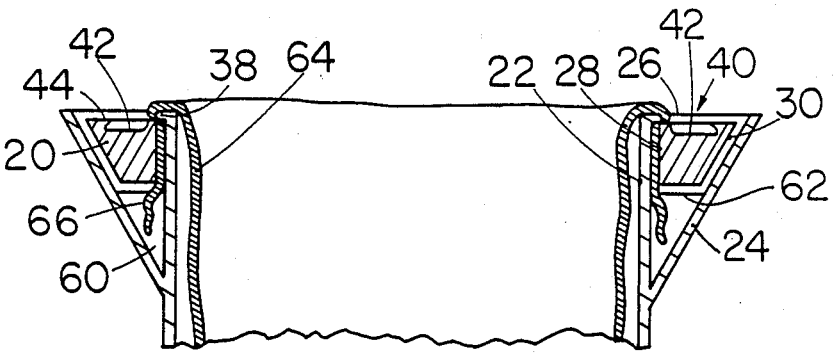
FIG. 4 is a view in section similar to FIG. 3 but showing the retainer ring member inserted into the channel over the liner mouth material.

Referring now to FIG. 4, the retainer ring member 20 is adapted to be received in the retainer channel 18 over the liner bag mouth portion material 66 previously positioned in the channel. The inner surface 28 of the retainer ring member 20 substantially abuts a portion of the inner channel wall 22 but with the liner material interposed between the two so as to be held in the channel. Excess liner mouth portion material 66 is pushed by the insertion of the retainer ring member 20 into the excess channel portion 60 so that the material is contained in the excess channel portion. Note that the excess channel portion may be much smaller than is shown in the figures and still have the ability to contain a substantial amount of excess liner mouth material due to the flexibility and thinness of the liner material.

In order to be received in the channel in the position shown in FIG. 4, the retainer ring member must be passed over the retainer ridge members 38 extending into the channel 18. In the preferred form of the invention the retainer ring member 20 is made of a suitable somewhat flexible plastic matèrial adapted to flex outwardly toward the outer channel wall 24 sufficiently to pass over the ridge members 38. Once past the ridge members 38 as in FIG. 4, the retainer ring member 20 snaps back toward the inner channel wall 22 to hold the liner mouth portion material 66 securely in the channel. In other forms of the invention the retainer ridge members may be positioned in the channel to align with an indentation in the retainer member. In still other forms of the invention the retainer ridge member may be formed on the retainer ring member and cooperating indentations may be formed on one of the channel walls.

FIGS. 3 and 4 also show the preferred form of the grip indentation 42 and lip portion 44 type removal grip means 40 associated with the retainer ring 20. The lip portion 44 of each grip indentation 42 is positioned on the outer edge of the indentation nearest the outer surface 30 of the retainer ring member 20. In this preferred position, each lip portion 44 may be gripped with a finger tip or fingernail to pull the retainer ring member 20 up and also outwardly toward the outer channel wall 24. This outward pulling force helps flex the retainer ring 20 outwardly for removal from the retainer channel 18 over the ridge members 38.

Figure 5:
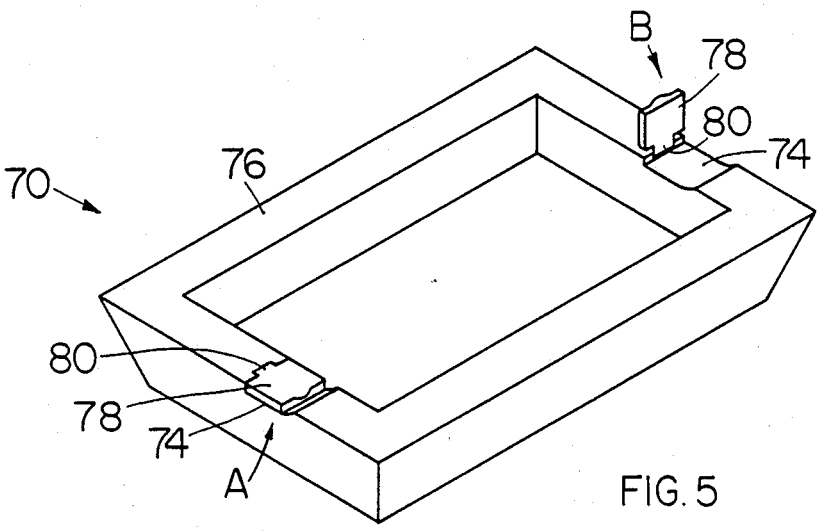
FIG. 5 is a view in perspective of an alternate retainer ring member embodying the principles of the invention.

A retainer ring member 70 having an alternate preferred removal grip means 72 is illustrated in FIG. 5. In this form of the invention the removal grip means 72 includes two grip member receiving indentations 74 on the top surface 76 of the retainer ring 70. A grip member 78 is pivotally connected to the retainer ring member 70 in each indentation 74 by a suitable grip pivot connection 80. Each grip member 78 is adapted to pivot between a retracted position, shown as A in FIG. 5 in which the grip member is received substantially in its particular corresponding indentation, and an extended position shown at B. In the extended position the grip member 78 extends substantially above the top surface 76 of the retainer ring member 70 in position to be grasped for pulling the retainer ring member from a retainer channel such as that shown in FIGS. 1–4. As in the retainer ring member 20 shown in FIGS. 1–4, the ring member 70 of FIG. 5, as well as the removal grip member 78, may preferably be made from a suitable somewhat flexible plastic material. A number of other embodiments of retractable grip means may be envisioned by those skilled in the art without departing from the spirit of the invention as defined by the claims below.

As best illustrated in FIG. 5, the retainer member 70 preferably includes a single ring of material adapted to fit in the retainer channel (18 in FIGS. 1–4) along the entire length of the channel. However, a retainer member pursuant to the invention may include several separate retainer member portions (not shown), each portion adpated to be inserted in a different portion along the length of the channel. Furthermore, although the retainer member preferably is adapted to be received in a corresponding channel along the entire perimeter of a deposit opening for retaining a liner mouth portion, the liner retainer according to the invention may include separated channel portions and separate retainer members spaced out along the perimeter of a deposit opening.

Figure 6:
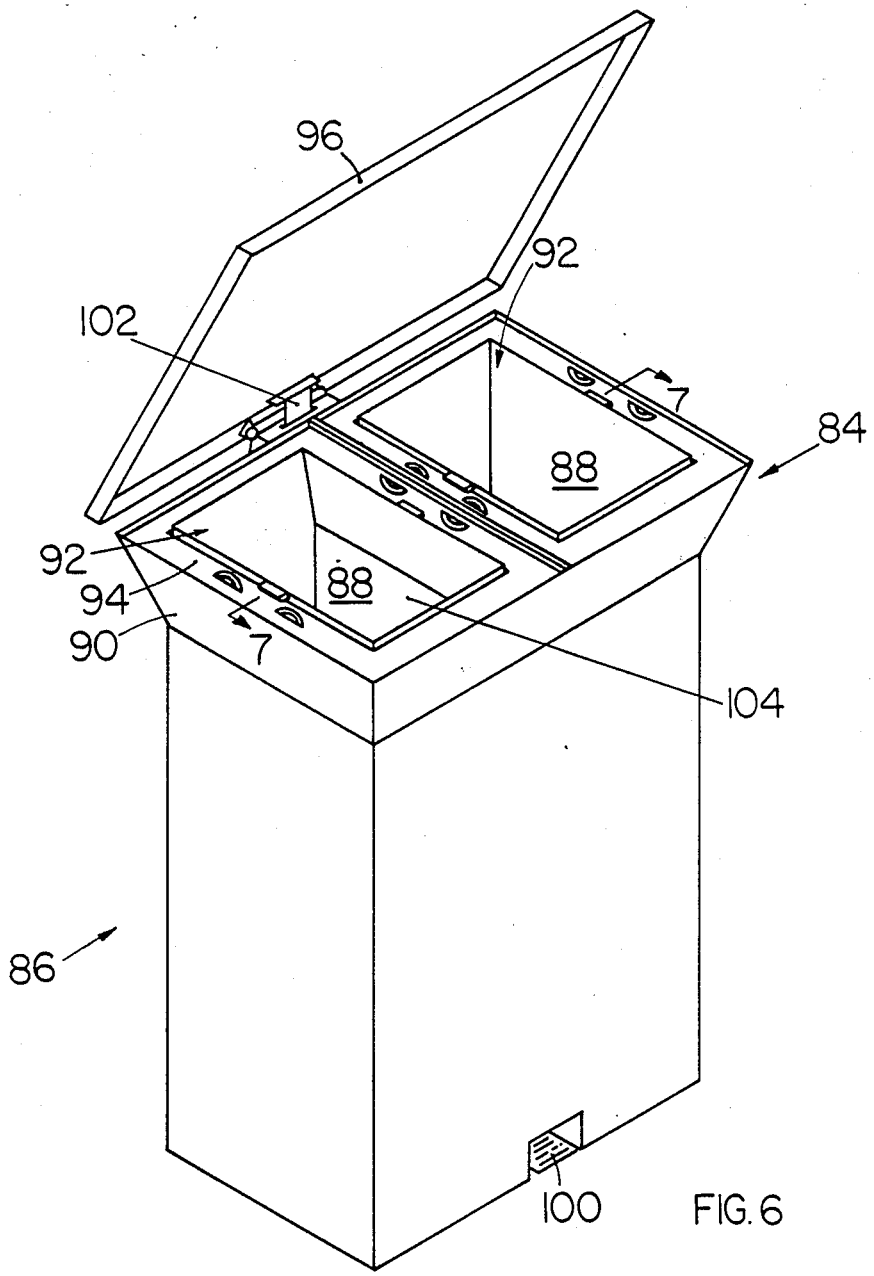
FIG. 6 is a view in perspective showing a trash receptacle according to the invention having multiple compartments and a liner retainer for each separate compartment.
Figure 7:
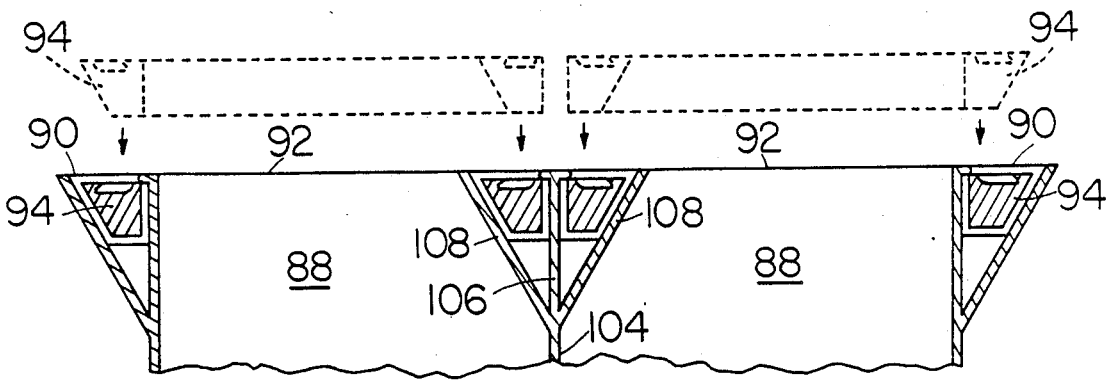
FIG. 7 is a view in section taken along line 7—7 in FIG. 6 showing the two liner retainers each with a separate retainer ring member inserted therein and also showing in phantom the retainer rings removed from the channels.

FIGS. 6 and 7 show another preferred form of the liner retainer 84 as used with a trash receptacle 86. In this form of the invention, the trash receptacle 86 includes two separate receptacle compartments 88 which may be used for segregating different types of trash, for recycling for example. Each trash receptacle compartment 88 has a retainer channel 90, similar to that described with reference to FIGS. 1–4, connected to and extending around preferably the entire perimeter of a compartment deposit opening 92. Also, each retainer channel 90 is adapted to receive a separate retainer ring member 94 previously described with reference to FIGS. 1–5. The multiple compartment trash receptacle 86 shown in FIG. 6 also includes a lid 96 and lid raising mechanism, having a foot pedal member 100 and lifting member 102 similar to that shown in FIGS. 1 and 2. Note again that the lid 96 is connected to the receptacle outside of the perimeter of the retainer channels 90 and the lifting member 102 also extends outside of said perimeter, the liner retainer thus preventing a liner retained properly therein from interfering with the lid or the raising mechanism.

Referring particularly to FIG. 7, but also shown somewhat in FIG. 6, the two receptacle compartments 88 share a common receptacle wall 104. Also, the two retainer channel 90 share a common channel outer wall 106 which is preferably simply the upper portion of the common receptacle wall 104. Since the two channels 90 share a common outer channel wall 106, the inner channel wall 108 along the receptacle wall 104 must diverge from the common outer channel wall inwardly, into the area of the receptacle opening 92. The two inner channel walls 108 extending along the shared receptacle wall preferably angle continuously inwardly so as to form no ledges which might snag a full liner bag as it is removed from the receptacle compartment through the top or deposit opening 92.

Figure 9:
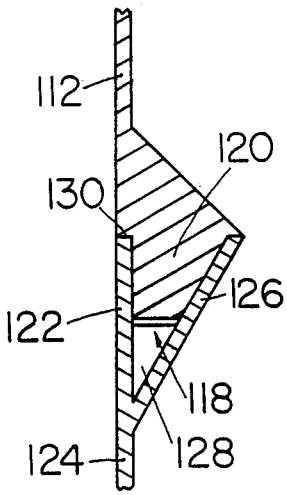
FIG. 9 is a partial section view showing the receptacle cover of FIG. 8 connected to the receptacle.
Figure 8:
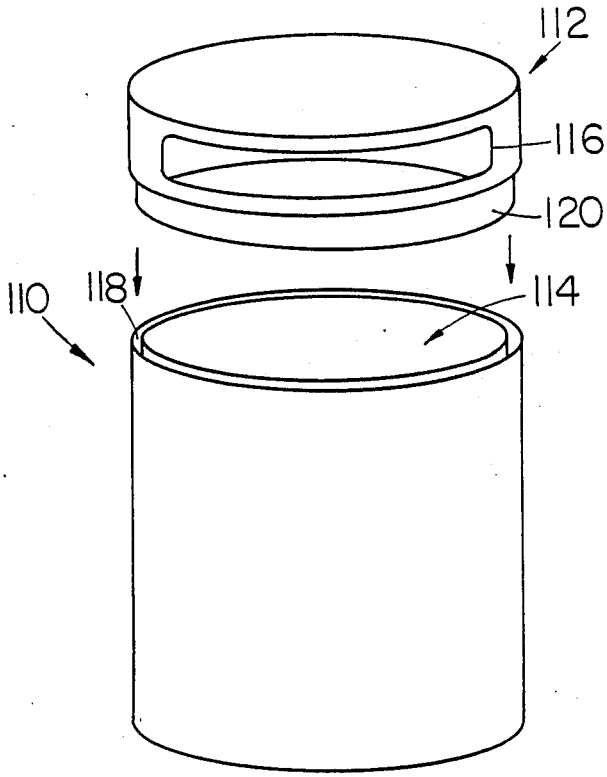
FIG. 8 is a view in perspective of an alternate form of the invention.

FIGS. 8 and 9 show yet another preferred form of the invention. As shown in FIG. 8, the trash receptacle 110 in this form of the invention includes a receptacle cover 112 adapted to be placed over the receptacle top or deposit opening 114. The cover 112 includes a cover opening 116 through which trash may be deposited into the trash receptacle 110 when the receptacle cover is positioned properly over the receptacle opening 114. A retainer channel 118 similar to those iilustrated in FIGS. 1–4, 6, and 7 is connected to and extends around the entire perimeter of the receptacle deposit opening 114. However, in this form of the invention the retainer member 120 is formed on the bottom of the receptacle cover 112.

As shown best in FIG. 9, the retainer channel 118 includes an outer channel wall 122, being a continuation of the receptacle wall 124, and an inner channel wall 126 extending from the outer channel wall into the receptacle opening area. As in the embodiments discussed previously the channel 118 includes an excess channel portion 128. The channel 118 also preferably includes rib members (not shown) such as the rib members 62 of FIG. 1.

The retainer ring member 120 is preferably integrally formed with the receptacle cover 112, extendign downwardly from the cover in position to be inserted into the retainer channel 118 over a flexible liner bag mouth portion (not shown) received in the channel as described with reference to the embodiment shown in FIGS. 3 and 4. In this form of the invention no retainer ridge members are provided along the top of the retainer channel since the weight of the receptacle cover is sufficient to retain the retainer ring member in the retainer channel. However, ridge members as previously discussed may be used for helping to retain the retainer member and cover in position on the receptacle. Also, the receptacle cover 112 includes a stop ledge 130 adapted to substantially abut the top of one of the channel walls, in this embodiment the outer channel wall 122, when the retainer rimg member 120 is properly received or inserted in the retainer channel 118.

The above described preferred embodiments are intended, by way of example, to illustrate the principles of the invention, but not to limit the scope of the invention. Various other embodiments and modifications to these preferred embodiments may be made by those skilled in the art without departing from the scope of the following claims.

I claim:

1. A liner retainer for retaining the mouth of a flexible liner bag open and in position for receiving objects in the liner bag, the liner retainer comprising.

retainer channel means for receiving the mouth portion of the liner bag, the retainer channel means being connected to and extending along at least a portion of the perimeter of a deposit opening and an opposing sides of the opening;

retainer member means adpated to be received in the retainer channel means, over the mouth portion material of the liner bag received in the channel means, for retaining the mouth portion of the liner bag in the retainer channel means; and an excess channel portion at the bottom of the retainer channel means, into which the retainer member means does not extend when the retainer member means is fully received in the retainer channel means, the excess channel portion being adapted to receive excess liner mouth material so that said excess material does not substantially interfere with the fit of the retainer member means in the retainer channel means.

2. The liner retainer of claim 1 wherein the retainer channel means extends along substantially the entire perimeter of the deposit opening.

3. The retainer member of claim 2 including retainer member contact means associated with the retainer channel means and the retainer member means for providing sufficient contact between the retainer member means and the retainer channel means when the retainer member means is properly received in the retainer channel means to retain the retainer member means in the retainer channel means.

4. The liner retainer of claim 3 wherein the retainer member means is a unitary continuous ring member.

5. The liner retainer of claim 4 wherein the channel means includes:

an inner channel wall;

an outer channel wall, a retainer channel being defined between the inner channel wall and the outer channel wall; and a channel top opening through which the ring member may be inserted into the retainer channel.

6. The liner retainer of claim 5 wherein the retainer ring member includes:

an inner ring member surface adapted to substantially abut at least a portion of the inner channel wall along substantially the entire length of the retainer channel when the ring member is properly received in the retainer channel;

an outer ring member surface adapted to substantially abut at least a portion of the outer channel wall along substantially the entire length of the retainer channel when the ring member is properly received in the retainer channel; and a top ring member surface adapted to substantially align with and cover the channel top opening when the ring member is properly received in the retainer channel.

7. The liner retainer of claim 6 including a plurality of channel rib members spaced out along substantially the entire length of the retainer channel, each rib member connected to and extending between the inner channel wall and the outer channel wall in the excess channel portion.

8. The liner retainer of claim 7 wherein the retainer member contact means includes retainer ridge means connected to the retainer channel along the inner channel wall near the channel top opening for helping to retain the retainer ring member in the retainer channel when the ring member is properly received in the channel, the channel ridge means extending a small distance into the retainer channel and over which the retainer ring member must pass in order to be properly received in the channel and to be removed from the channel.

9. The liner retainer of claim 8 wherein the inner channel wall and the outer channel wall form substantially an acute angle with each other, said channel walls being connected at a lower channel point and diverging toward the channel top opening.

10. The liner retainer of claim 9 wherein the ring member includes removal grip means for providing a gripping area on the ring member by which the ring member may be grasped and removed from the retainer channel, the removal grip means being adapted to be positioned below the top ring member surface when the ring member is received in the channel.

11. The liner retainer of claim 10 wherein the removal grip means includes:

a plurality of grip indentations on the top ring member surface; and a plurality of lip portions, one lip portion associated with each grip indentation, each lip portion extending into said associated grip indentation and adapted to be grasped for facilitating removal of the ring member from the retainer channel.

12. The liner retainer of claim 10 wherein the removal grip means includes:

a plurality of grip members receiving indentations in the top surface of the ring member; and a plurality of grip members, one grip member associated with each grip member receiving indentation, each grip member being movably connected to the ring member in one of the grip member receiving indentations and adapted to move between a retracted position in which the grip member is received substantially in said grip member receiving indentation, and an extended position in which the grip member extends substantially above the retainer ring member top surface in position to be easily grasped for removing the retainer ring member from the retainer channel.

13. The liner retainer of claim 2 wherein the retainer channel means is integrally formed with the deposit opening of a trash receptacle compartment.

14. A waste receptacle comprising:

at least one waste receptacle compartment adapted for being lined with a liner bag made entirely of a thin flexible material and having a liner mouth through which trash may be deposited into the liner bag;

a deposit opening in the top of each waste receptacle compartment through which trash may be deposited into the respective waste receptacle compartment;

retainer channel means, connected to and extending around substantially the entire perimeter of each deposit opening, for receiving the mouth portion of the liner bag lining each compartment, the retainer channel means having a substantially V-shaped portion being defined between an inner channel wall and an outer channel wall which are connected together at a lower channel point at the receptacle deposit opening and diverge at a substantially acute angle toward a channel top opening; and retainer member means for each retainer channel means, each retainer member means being adapted to be received in a different retainer channel means through the channel top opening and over the mouth portion of the liner bag received in the retainer channel means, for retaining the mouth portion material in the retainer channel means and for substantially covering the channel top opening so that waste material may not collect in the retainer channel means as the lined waste receptacle is filled.

15. The waste receptacle of claim 14 including a plurality of waste receptacle compartments arranged in a side-by-side fashion sharing a common receptacle wall and a common outer channel wall connected to and extending upwardly from the common receptacle wall.

16. The retainer member of claim 14 including retainer member contact means associated with each retainer channel means and each retainer member means for providing sufficient contact between each retainer member means and its corresponding retainer channel means when the retainer member means is properly received in the retainer channel means to retain the retainer member means in the retainer channel means.

17. The waste receptacle of claim 16 wherein each retainer ring member means is a unitary continuous ring member and includes:

an inner ring member surface adapted to substantially abut at least a portion of the inner channel wall along substantially the entire length of the retainer channel when the ring member is properly received in the retainer channel;

an outer ring member surface adapted to substantially abut at least a portion of the outer channel wall along substantially the entire length of the retainer channel when the ring member is properly received in the retainer channel; and a top ring member surface adapted to substantially cover the channel opening when the ring member is properly received in the retainer channel.

18. The waste receptacle of claim 17 wherein each retainer channel includes an excess channel portion at the bottom of the retainer channel, opposite the channel top opening, into which the ring member does not extend when the ring member is properly received in the channel, the excess channel portion being adapted to receive excess liner mouth portion material.

19. The waste receptacle of claim 17 wherein each retainer member contact means includes retainer ridge means connected to the channel along the inner channel wall near the channel top opening for helping to retain the retainer ring member in the retainer channel when the ring member is properly received in the channel, the channel ridge means extending a small distance into the retainer channel, and over which the retainer ring member must pass in order to be properly received in the retainer channel and removed from the retainer channel.

20. The waste receptacle of claim 17 wherein each ring member includes removal grip means for providing a gripping area on the ring member by which it may be grasped and removed from its respective channel, the removal grip means being adapted to be positioned below the top ring member surface when the ring member is received in the channel.

21. The waste receptacle of claim 20 wherein the removal grip means includes:

a plurality of grip indentations on the top surface of each ring member; and a plurality of lip portions, one lip portion associated with each grip indentation, each lip portion extending into its respective grip indentation and adapted to be grasped for facilitating removal of the ring member from the retainer channel.

22. The waste receptacle of claim 20 wherein the removal grip means includes:

a plurality of grip member receiving indentations in the top surface of each ring member; and a plurality of grip members, one grip member associated with each grip member receiving indentation, each grip member being movably connected to the ring member in one of the grip member receiving indentations and adapted to move between a retracted position in which the grip member is substantially received in its respective grip member receiving indentation, and an extended position in which the grip member extends substantially above the retainer ring member top surface in position to be easily grasped for removing the retainer ring member from the channel.

23. The liner retainer of claim 20 including a plurality of channel rib members spaced out along substantially the entire length of each retainer channel, each rib member connected to and extending between the inner channel wall and the outer channel wall in the excess channel portion.

24. The waste receptacle of claim 17 wherein the inner channel wall of each receptacle compartment extends upwardly from a receptacle wall around the entire perimeter of each receptacle deposit opening so that the retainer channel means does not extend into the area of the deposit opening to which it is connected.

25. The waste receptacle of claim 17 wherein:

the outer channel wall of each waste receptacle compartment extends upwardly from a receptacle wall at least along a portion of the perimeter of each deposit opening; and the inner channel wall along said portion of each deposit opening extends inwardly into the area of the deposit opening only a short distance and at an acute angle from the lower channel point, so that each retainer channel means, although its area is smaller than the area of the deposit opening, does not substantially impede the removal of a full liner bag through the receptacle deposit opening to which the retainer channel means is connected.

26. The waste receptacle of claim 14 wherein each retainer channel means is integrally formed with its respective deposit opening.

27. The waste receptacle of claim 14 including:

a lid member pivotally connected to the waste receptacle outside of the perimeter of the channel means and adapted for pivoting between a lowered position covering the deposit opening of each receptacle compartment and a raised position exposing the deposit opening of each receptacle compartment; and foot operated lid raising means for raising the lid member to its raised position and for lowering the lid to its lowered position.

28. The waste receptacle of claim 27 wherein the lid raising means includes:

a foot pedal member pivotally connected to the receptacle near the bottom thereof; and an elongated lifting member slidably mounted on the waste receptacle outside of the waste receptacle compartments and extending between the foot pedal member and the lid member, the lifting member being adapted to be lifted upward by the foot pedal member and to contact the lid member at a point outside of the perimeter of the liner retainer channel so as to raise the lid member to its raised position.

29. The waste receptacle of claim 14 wherein the retainer ring means is formed on a deposit opening cover adapted for mounting on the waste receptacle to cover the deposit opening of each receptacle compartment, the deposit opening cover having a cover opening through which trash may be deposited into each receptacle compartment.

30. A method for retaining a flexible liner bag in position for receiving trash, the liner bag having a liner mouth opening through which trash may be deposited in the liner bag, the method comprising the steps of:

positioning the liner mouth portion material in a liner retainer channel;

inserting retainer member means into the liner retainer channel over the liner mouth portion material received in the channel thereby pressing substantially all of the liner mouth portion material into the channel and substantially covering the liner retainer channel; and retaining the retainer member means in the channel.

31. The method of claim 30 wherein the step of retaining the retainer member means includes contacting the retainer member means and the retainer channel when the retainer member means is properly received therein with contacting means.

32. The method of claim 31 wherein:

the step of inserting the liner retainer member means into the liner retainer channel includes inserting the retainer ring past at least one ridge member of the contacting means near the top of the retainer channel; and the step of retaining the retainer member means in the liner retainer channel includes catching the retainer member means on the ridge member.

* * * * *